United States Patent [19]

Taylor, III et al.

[11] Patent Number: 5,049,743

[45] Date of Patent: Sep. 17, 1991

[54] SURFACE LOCATED ISOTOPE TRACER INJECTION APPARATUS

[75] Inventors: Lawrence Taylor, III, Katy; John W. Chisholm, Houston, both of Tex.; Philip T. Thayer, Littleton, Colo.

[73] Assignee: ProTechnics International, Inc., Houston, Tex.

[21] Appl. No.: 466,237

[22] Filed: Jan. 17, 1990

[51] Int. Cl.[5] ..... G21H 5/02

[52] U.S. Cl. ..... 250/303; 250/260

[58] Field of Search ..... 250/303, 260

[56] References Cited

U.S. PATENT DOCUMENTS 3,332,744 7/1967 Henderson et al. ..... 250/303

4,877,956 10/1989 Priest ..... 250/260

OTHER PUBLICATIONS

Taylor et al., Petroleum Engineer International, Jul. 1989.

*Primary Examiner*—Jack I. Berman

*Attorney, Agent, or Firm*—Gunn, Lee & Miller

[57] ABSTRACT

The present disclosure is directed to a method and apparatus for controllably injection a radioactive isotope tracer fluid into a fracture fluid, a manifold or mud flow line connected to a well. It is best used in measuring well stimulation procedures based on injection of tracer isotopes so that stimulation performance data can be obtained by gamma ray spectroscopic measuring instruments lowered in the well borehole after fracture. The present apparatus utilizes a tank supply of tracer fluid connected through a pump into the mud line wherein the pump drives a tachometer, and utilizes a CPU to respond to pumping rate measurements and adjust the pumped rate of the tracer fluid.

13 Claims, 1 Drawing Sheet

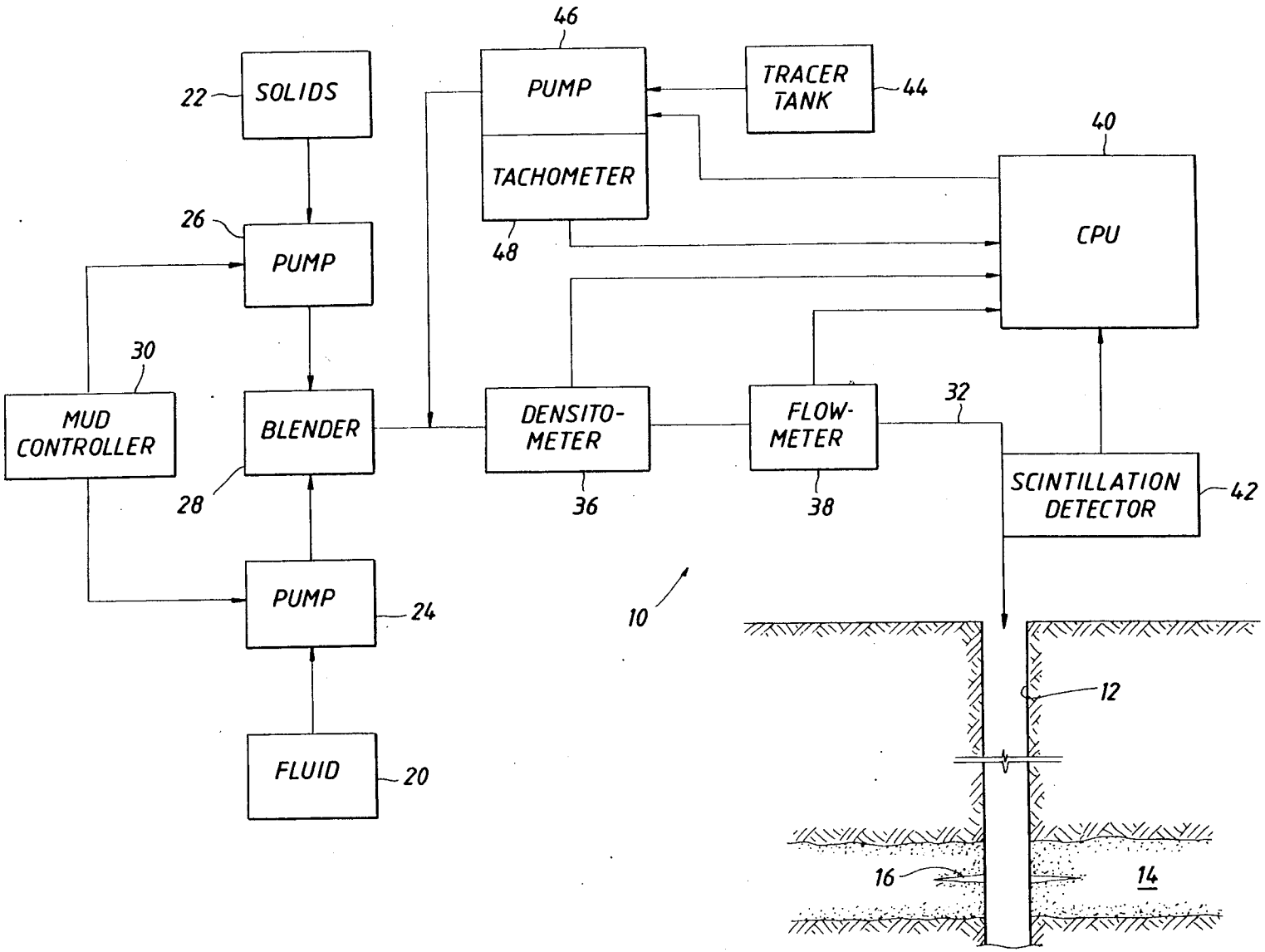
CPU
40
SCINTILLATION DETECTOR
42
12
14
16
32
TRACER TANK
44
FLOW-METER
38
10
PUMP
TACHOMETER
46
48
DENSITO-METER
36
SOLIDS
22
PUMP
26
BLENDER
28
PUMP
24
FLUID
20
MUD CONTROLLER
30

SURFACE LOCATED ISOTOPE TRACER INJECTION APPARATUS

BACKGROUND OF THE DISCLOSURE

After an oil or gas well has been drilled and a pay zone has been found, it is typically perforated to extend flow paths from the well into the pay zone(s) of interest. There are numerous stimulation procedures which enhance the production of the zone into the borehole. These procedures include treating the zone with various fluids including a procedure which props open the fractures in the zone to thereby improve fluid flow into the borehole. A fracture is often initiated by packing off the well above and below the perforations, and subjecting the perforations and the formation to hydraulic pressure by raising the pressure sufficiently to cause fracturing, and thereafter relieving the fracture. It is a procedure which is only inferentially analyzed from the surface. Measurements can be taken along the borehole to lead to estimates, perhaps even accurate quantification of fracturing parameters including measurement of the vertical fracture height. One technique used is the injection of a radioactive isotope tracer for the purpose of measuring the fractures in the region of the wellbore.

By definition, a tracer placed in the formation provides an appropriate radioactive emission which can be detected with a suitable detector in the borehole. But, this detected signal is always obscured by the background radiation associated with that particular formation. If a single tracer is used, some data can be obtained dependent on the location of the tracer in the fracture fluid. In this regard, it is generally possible to provide soluble tracer elements, including those which are selectively soluble in water or oil but not both. Also, particulate tracer elements can be placed in the formation through the use of encapsulated particles which are intended to behave like particulate sand in the formation. In any case, gamma spectroscopy techniques involve making measurements of gamma ray energy in selected windows of the spectrum to enable presentation of a log which will show appropriate radiation levels from injected radioactive isotope tracers in the formation.

Typically, this procedure occurs after making perforations through the casing, adjacent and surrounding cement layer, and into the formation. The casing is a shield of relatively dense, energy absorbing materials around the locus of the gamma responsive device placed in the borehole. The selected tracer isotope is chosen in part for the energy levels of photopeaks of the gamma emissions therefrom and in part based on the relative half life. For instance, it is possible to use a tracer with a half life of just a few days; other tracer isotopes provide half lives which are as high as sixty days (for $^{124}$antimony) and even higher. Obviously, there are longer isotope half lives, but they are typically not chosen for a variety of reasons. The tracer is normally injected with the fracture fluid and proppant. The fracturing fluid must be mixed at the surface before it is delivered into the formation. In most instances, the well known fracture fluid is mixed at the surface (it is primarily water plus selected solids) and it is mixed either on a continuous or batch basis, density is checked, and the fracture fluid is then pumped through high pressure pumps into the formations of interest. During this, it is desirable to inject the tracer element. Radioactive isotope detection is dependent on the concentration and the half life of the tracer. If, for instance, the tracer $^{198}$Au is used, it has a half life of only 2.7 days, and it must be quickly measured to provide a calibration standard to take into account its relatively short half life. Obviously, the quantity of tracer placed in the fracture fluid must also be determined. Thus, calibration for the measurements must be obtained at the surface so that suitable, useful and correct standards are available for making the later measurements, particularly preliminary to performance of the fracture job. It may not be known precisely in advance how much of the fracture fluid must be mixed, and one may equally be ignorant of the actual quantity of fracture fluid delivered into the formation. The size of the job can be estimated; the actual fluid injected in altogether a different measure.

Through the use of an exemplary radioactive isotope tracer, a first formation can be tested. If there is another formation perforated from the same well, it is desirable to use a different tracer for that stage. Accordingly, a second or another radioactive isotope tracer may be mixed for another slug of the fracture fluid. This might be tested with a different tracer; and if the first formation is tagged with the tracer $^{198}$Au, an alternate might be $^{46}$Sc. These are particularly desirable in a common test because the peak gamma radiation for gold is found at 412 KeV while scandium has peaks at 889 and also 1121 KeV.

To further complicate the foregoing, the initial fracturing proppant can be delivered with a first isotope and the last portions delivered can be tagged with a different tracer. This will help evaluate the proppant placement in the fractured formation with the view that the initial delivery of fracture proppant (presumably sand) is more deeply placed in the formation than the last delivered sand. Certain of these advantages have been set forth in some detail by the inventor of the present disclosure in the July 1989 issue of *Petroleum Engineer*. As detailed in that article, there are numerous ways to use single or multiple radioactive isotope tracer elements which are detected by gamma spectroscopy wherein the log interpretation provides some information regarding the success of the hydraulic fracturing procedure.

It is very helpful to carry out tracer injection subject to calibration. The apparatus of the present disclosure is directed to this. It is particularly useful because it is installed at the surface. Routinely, the fracture fluid is mixed at the surface and is delivered through high pressure pumps into the well borehole. At the surface, this involves the use of several large trucks to deliver the solids and fluid, and large blenders with one or more truck mounted pumps. Typically, they are connected on a common manifold system. In turn, this cooperates with the blender to provide connection from the manifold into the borehole for delivery of the mixed fracture fluid.

This mixing routine accomplishes delivery of a fracture fluid having a specific weight and volume. Typically, hydraulic fracturing treatments are carried out at specified pump pressures, flow rates and surface conditions which can be readily measured. It is in that context that the present disclosure enhances the mixing of the fracture fluid to provide the precise and controlled addition of a radioactive isotope tracer in the fracture fluid to assure proper mixing. The present apparatus thus incorporates a scintillation detector positioned adjacent the mud flow line prior to injection into the well to measure the radiation level and hence the relative quantity of tracer injected in relation to the fracture fluid flow rate. A supply of tracer material is provided and is delivered by a pump into the mud flow line. The pump is an adjustable speed, adjustable flow pump. Accordingly, it provides an output which is sufficiently high in pressure to overcome the back pressure prevailing in the fracture fluid flow line. Fracture fluid is measured by directing that flow through a densitometer and flowmeter. All of this data is delivered to a CPU which forms continuous calculations to determine the flow rate, thereby enabling proportioning of the tracer to the fracture fluid.

The present apparatus can be duplicated for injection of two or more different tracers sequentially or simultaneously into the fluid, etc. Moreover, the calibration of the rates at which the tracer elements are added enables the subsequent testing and measuring of the fracture height along the formation adjacent to the borehole. Measurements can be obtained through the use of gamma spectroscopic measuring devices lowered into the borehole after injection of the tracers. A method of injecting a fracture fluid into a formation through a well borehole is also set forth particularly featuring incorporation of tracer elements.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

The single drawing is a schematic block diagram showing apparatus involved in mixing of fracture fluid and particularly showing the present system which controllably adds radioactive tracer isotopes to the fracture fluid in a controlled proportion at the surface.

DETAILED DESCRIPTION OF THE PREFERRED EMBODIMENT

In the only view submitted, a fracture stimulation mixing apparatus is illustrated in schematic form at the surface. It is used in conjunction with a completed well to enhance production from a specific formation. Accordingly, the numeral 10 identifies the surface located equipment including the fracture fluid mixing system. It is connected to the well 12 which is typically a cased well having a cased cemented in place from the surface and extending through a formation 14. At selected locations in the formation, perforations 16 are formed which extend from the borehole into the formation. The formation 14 is the formation which is to be fractured in the well stimulation procedure involve. Preliminary steps normally involve placement of packers above and below the formation 14, and subsequent pumping of fracture fluid into the packed off zone so that the pump pressure forces the hydraulic fluid into the perforations 16 to flow out into the respective formations, with consequential improvement in production. One of the parameters relating to fracture success is the height of the fracture vertically along the borehole. In part, this can be measured by the intrusion of the fracture fluid which carries the radioactive isotope tracer elements into that portion of the formation. Accordingly, fracture height and extent of fracture can then be determined by measuring the radiation levels in the borehole with a gamma spectroscopic measuring tool.

So that the above can be accomplished, the present apparatus cooperates with a fracture fluid mixing system. To this end, the numeral 20 identifies a source of fracture fluid to be mixed with solids from a source 22. Typically, the solids include particulate matter such as sand. In any case, the fluid is delivered through a pump 24 while the solids are delivered through a similar pump 26. The two pumps deliver the fluid and solid material to a blender 28. The blender 28 is operated in a continuous or batch fashion. A controller 30 is connected to the two pumps and operates them for delivery of specified volumes of fluid and solids to mix to thereby form the fracture fluid. The fracture fluid is typically mixed and is delivered through a mud line 32 connected directly to the well head. This delivers the fracture fluid in the well in sufficient volume to obtain the formation fractures desired.

The solids and fluid delivered for the fracture job can total several thousand gallons of fracture fluid. Indeed, the volume can be exceedingly large and to this end, a manifold is normally assembled connecting with a number of pump trucks which are driven to the well head site. The several pump trucks are typically provided with common connections on the manifold line so that the mixed fracture fluid is thereby delivered at appropriate high pressures into the mud line 32.

In the ordinary deployment of mixing equipment, there will typically be one or more trucks mounting the mixing device or blender 28. In that instance, they deliver the output flow through the mud line which is then metered for purposes of the present apparatus. The metering involves measurement of the fracture fluid density by the densitometer 36. In addition to that, the flow rate must be measured and a flowmeter 38 is used for that. The densitometer and flowmeter are installed serially in the mud line 32. They form output signals which are delivered to a CPU 40, the CPU being provided with the two inputs just mentioned and additional inputs. A scintillation detector 42 is located adjacent to the flow of fracture fluid. The radiation levels of the fracture fluid are measured by this, and that data is input to the CPU 40. A supply of radioactive tracer isotope is indicated at 44. This supply is delivered to a pump 46. The pump operates at a rate measured by a tachometer 48. The output of the pump is thus proportionate to the pulses output by the tachometer. For instance, calibration standards for the pump can be obtained. As an example, the output might be one cc/revolution for a rotary pump. Thus, the tachometer measures the number of rotations and forms an output of this which is provided to the CPU 40.

The controller 30 is adjusted to control the rate of operation of the pumps 24 and 26. In turn, the fracture fluid which is formed by the blender reflects the ratio of fluid/solids to thereby output a fracture fluid at a specified pressure, having a specified density, and totalling a specified volume. The density and volume are measured by the meters 36 and 38. As the blender 28 varies in speed, the rate of output will vary. This change in flow is measured by the flowmeter 38. In any case, the fracture fluid is mixed and delivered into the well 12 to carry out the formation fracture process mentioned above. While this is being done, the pump 46 is operated to deliver a specified rate of radioactive isotope tracer injection into the fracture fluid flow. The pump is operated at a rate to provide a certain amount of tracer per specified volume of fracture fluid. A tracer rate of delivery is specified by the CPU. This input data serves as a set point so that the measured rate of injection can be adjusted. If insufficient radioactive tracer is being injected at an instant, the pump 46 is speeded up by providing a control signal to the pump for increased pump speed. When the pump is operated faster, more tracer is injected into the fracture fluid, and this increase will be observed at detector 42. When that increase is observed, the detector 42 notes the change in gamma radiation and provides a signal indicative of that change to the CPU 40.

Certain practical things need to be observed. The pump 46 is injecting a very small flow rate of tracer fluid into the fracture fluid. The ratio is indeed much greater than 1,000:1, and typically can be about 10,000 to 100,000 units of fracture to 1unit of radioactive isotope tracer fluid. To that end, the pump 46 can be connected into the mud line 32 at a downstream location on the mud line. This will not materially change the data from the densitometer 36 and flowmeter 38. The radioactive material can be injected into the mud line at least a few inches, and preferably three or four feet upstream of the detector 42. The detector 42 can be installed at any location downstream from the injection point before the fluid carrying the radioactive isotope tracer. It can be located at the well head or on the manifold line or elsewhere so long as it is downstream of the injection point for the radioactive isotope tracer fluid.

The foregoing describes the system for injection of a single tracer. A second and alternate tracer can also be injected utilizing the same pump and tachometer arrangement shown. In that instance, it is preferably injected downstream of the detector 42 so that the detector 42 measures only the injected first tracer. Should a second tracer be added, a second detector can be used. The second detector will typically, however, respond to both radioactive isotope tracers flowing therepast. The data from the detector 42 is thus used to specify the flow rate of the first tracer. The second detector will observe both flow rates assuming that the isotopes have photo peaks which are within the sensitive range of the detector. In any event, since the second detector will measure both, it is desirable that the second detector be lagged in its adjustments so that it is somewhat more insensitive in response time to assist in sorting out the two tracers which flow past the second detector.

Several tracers can be provided in separate tanks where one is pumped by the pump 46 for a specified interval or until a specified event has occurred whereupon the first tracer tank is disconnected and a second tracer tank is then connected. This delivers two separate tracers into the formation which tracers are typically located at different points in the formation as a result of the different delivery times to the formation. In the foregoing example, the preferred fluid injectant is fracture fluid. An alternate fluid is acid which is used to enhance formation production. Other alternates are cement or any other fluid pumped into a well from the surface.

While the foregoing is directed to the preferred embodiment, the scope thereof is determined by the claims which follow.

What is claimed is:

1. A method of controlling the flow of radioactive isotope tracers for injection into a well borehole comprising the steps of:

(a) providing a flow of treatment fluid at the surface wherein the fluid flow has desired characteristics and flow rate;

(b) injecting the fluid flow into a well at a controlled rate and pressure for formation treatment;

(c) adding a flow of fluid mixed with a radioactive isotope at the surface to the treatment fluid;

(d) prior to the entry of the treatment fluid flow into the well, measuring radioactivity of the treatment fluid resulting from the added radioactive isotope; and (e) dependent on the measured radioactivity, changing the relative proportion of treatment fluid flow and fluid carried radioactive isotope to obtain a desired level of radioactivity in relation to the treatment fluid flow.

2. The method of claim 1 wherein the treatment fluid is mixed by a blender and, after mixing, including the step of measuring fluid volumetric flow.

3. The method of claim 1 wherein the fluid is mixed by a blender and, after mixing, including the steps of measuring density of the fluid.

4. The method of claim 1 including the step of providing a first fluid carrying a first radioactive isotope into the fluid flow, and after termination thereof, adding a fluid carrying a second and different radioactive isotope.

5. The method of claim 1 including the step of providing a first fluid carrying a first radioactive isotope into the fluid flow and a second fluid carrying a second and different fluid radioactive isotope.

6. The method of claim 1 including the step of measuring radioactivity of the fluid flow by measuring the flow of fluid delivered through a mud line to the well head by a scintillation detector means.

7. The method of claim whereing the step of adding a fluid carrying an isotope therein includes:

(a) providing a supply of radioactive isotope carrying fluid in a container;

(b) pumping the fluid from the container;

(c) measuring the pumping rate;

(d) delivering the pumped flow into the flow of fluid; and (e) adjusting the rate of pumping to thereby obtain a specified proportion of fluid and fluid carried isotope.

8. The method of claim 7 wherein the isotope carrying fluid is water soluble.

9. The method of claim 7 wherein the isotope carrying fluid is oil soluble.

10. An apparatus for use with a system for delivery of a pumped fluid into a well from the well head, the apparatus comprising:

(a) first pump means for delivery of a flow of fluid and connected to a mud line connecting into a well for delivery of the fluid to the well;

(b) means for measuring the rate of flow of the fluid flow delivered into the mud line for the well from the first pump means;

(c) second pump means connected with a source of radioactive isotope tracer fluid wherein said second pump means has an output line connected with the mud line for delivery of the radioactive isotope tracer fluid into the fluid flow pumped by said first pump means;

(d) measuring means cooperative with the mud line for measuring the rate of flow of fluid into the well whereupon the rate of flow of radioactive isotope tracer is also measured; and (e) control means connected with said measuring means for controlling the rate of pumping of the radioactive isotope tracer fluid from said second pump means so that a specified flow rate thereof is obtained.

11. The apparatus of claim 10 including tachometer means for measuring the pump rate of said second pump means.

12. The apparatus of claim 11 further including means for measuring the rate of flow of the isotope tracer fluid.

13. The apparatus of claim 11 further including means for measuring the density of the fluid to provide a signal indicating density to said control means.

* * * * *